US007172027B2

(12) United States Patent
Simpson et al.

(10) Patent No.: US 7,172,027 B2
(45) Date of Patent: Feb. 6, 2007

(54) EXPANDING TUBING

(75) Inventors: Neil Andrew Abercrombie Simpson, Aberdeen (GB); Alexander Craig Mackay, Aberdeen (GB); David Graham Hosie, Sugar Land, TX (US); Ken Whanger, Houston, TX (US); Robert Badrak, Sugar Land, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 172 days.

(21) Appl. No.: 10/458,063

(22) Filed: Jun. 10, 2003

(65) Prior Publication Data

US 2004/0065445 A1 Apr. 8, 2004

Related U.S. Application Data

(63) Continuation-in-part of application No. 10/146,357, filed on May 15, 2002, now Pat. No. 6,896,052.

(30) Foreign Application Priority Data

May 15, 2001 (GB) ..... 0111779.5

(51) Int. Cl.
*E21B 23/01* (2006.01)

(52) U.S. Cl. ..... 166/382; 166/207; 166/242.2; 166/384; 166/387

(58) Field of Classification Search ..... None
See application file for complete search history.

(56) References Cited

U.S. PATENT DOCUMENTS

| | | | | |
|---|---|---|---|---|
| 761,518 | A | 5/1904 | Lykken | |
| 988,504 | A | 4/1911 | Pride | |
| 1,301,285 | A | 4/1919 | Leonard | |
| 1,324,303 | A | 12/1919 | Carmichael | |
| 1,545,039 | A | 7/1925 | Deavers | |
| 1,561,418 | A | 11/1925 | Duda | |
| 1,569,729 | A | 1/1926 | Duda | |
| 1,597,212 | A | 8/1926 | Spengler | 153/81 |
| 1,880,218 | A | 10/1932 | Simmons | |
| 1,930,825 | A | 10/1933 | Raymond | 153/81 |
| 1,981,525 | A | 11/1934 | Price | |
| 2,017,451 | A | 10/1935 | Wickersham | |

(Continued)

FOREIGN PATENT DOCUMENTS

DE 3213464 A1 10/1983

(Continued)

OTHER PUBLICATIONS

U.K. Search Report, Application No. GB 0412993.8, dated Aug. 26, 2004.

(Continued)

*Primary Examiner*—Zakiya W. Bates
(74) *Attorney, Agent, or Firm*—Patterson & Sheridan, LLP

(57) ABSTRACT

A method of expanding tubing downhole comprises providing a section of expandable tubing of a first diameter, and axially compressing the tubing to induce buckling, such that the buckled portion describes a larger second diameter. The resulting diametric expansion may be utilised to anchor or seal the tubing within a larger bore. The buckled portion may be used to anchor the tubing within the wellbore prior to expansion of the length of the tubing into the wellbore.

30 Claims, 13 Drawing Sheets

U.S. PATENT DOCUMENTS

| | | | | |
|---|---|---|---|---|
| 2,214,226 | A | 9/1940 | English | |
| 2,216,226 | A | 10/1940 | Bumpous | 36/44 |
| 2,383,214 | A | 8/1945 | Prout | 153/82 |
| 2,424,878 | A | 7/1947 | Crook | 154/82 |
| 2,499,630 | A | 3/1950 | Clark | 153/81 |
| 2,519,116 | A | 8/1950 | Crake | |
| 2,627,891 | A | 2/1953 | Clark | 153/82 |
| 2,633,374 | A | 3/1953 | Boice | 285/118 |
| 2,663,073 | A | 12/1953 | Bieber et al. | 29/148 |
| 2,754,577 | A | 7/1956 | Maxwell | 29/523 |
| 2,898,861 | A | 8/1959 | Hempel | 153/82 |
| 2,898,971 | A | 8/1959 | Hempel | 153/82 |
| 3,028,915 | A | 4/1962 | Jennings | |
| 3,039,530 | A | 6/1962 | Condra | |
| 3,087,546 | A | 4/1963 | Woolley | |
| 3,167,122 | A | 1/1965 | Lang | |
| 3,179,168 | A | 4/1965 | Vincent | |
| 3,186,485 | A | 6/1965 | Owen | |
| 3,191,677 | A | 6/1965 | Kinley | |
| 3,191,680 | A | 6/1965 | Vincent | |
| 3,195,646 | A | 7/1965 | Brown | 166/208 |
| 3,203,451 | A | 8/1965 | Vincent | 138/143 |
| 3,203,483 | A | 8/1965 | Vincent | 166/207 |
| 3,245,471 | A | 4/1966 | Howard | |
| 3,297,092 | A | 1/1967 | Jennings | 166/207 |
| 3,326,293 | A | 6/1967 | Skipper | |
| 3,353,599 | A | 11/1967 | Swift | |
| 3,354,955 | A | 11/1967 | Berry | |
| 3,467,180 | A | 9/1969 | Pensotti | 165/180 |
| 3,477,506 | A | 11/1969 | Malone | 166/207 |
| 3,489,220 | A | 1/1970 | Kinley | 166/277 |
| 3,554,280 | A * | 1/1971 | Tucker | 166/134 |
| 3,583,200 | A | 6/1971 | Cvijanovic et al. | 72/393 |
| 3,669,190 | A | 6/1972 | Sizer et al. | |
| 3,689,113 | A | 9/1972 | Blaschke | 285/90 |
| 3,691,624 | A | 9/1972 | Kinley | 29/523 |
| 3,712,376 | A | 1/1973 | Owen et al. | 166/277 |
| 3,746,091 | A | 7/1973 | Owen et al. | 166/207 |
| 3,776,307 | A | 12/1973 | Young | 166/125 |
| 3,780,562 | A | 12/1973 | Kinley | 72/479 |
| 3,785,193 | A | 1/1974 | Kinley et al. | 72/393 |
| 3,818,734 | A | 6/1974 | Bateman | 72/75 |
| 3,820,370 | A | 6/1974 | Duffy | 72/75 |
| 3,911,707 | A | 10/1975 | Minakov et al. | 72/76 |
| 3,948,321 | A | 4/1976 | Owen et al. | 166/277 |
| 3,977,076 | A | 8/1976 | Vieira et al. | 30/103 |
| 4,069,573 | A | 1/1978 | Rogers et al. | 29/421 |
| 4,127,168 | A | 11/1978 | Hanson et al. | 166/123 |
| 4,159,564 | A | 7/1979 | Cooper, Jr. | 29/727 |
| 4,288,082 | A | 9/1981 | Setterberg, Jr. | 277/125 |
| 4,319,393 | A | 3/1982 | Pogonowski | 29/434 |
| 4,324,407 | A | 4/1982 | Upham et al. | 277/27 |
| 4,349,050 | A | 9/1982 | Bergstrom et al. | 138/147 |
| 4,359,889 | A | 11/1982 | Kelly | 72/62 |
| 4,362,324 | A | 12/1982 | Kelly | 285/119 |
| 4,371,199 | A | 2/1983 | Kushner et al. | 285/382.2 |
| 4,382,379 | A | 5/1983 | Kelly | 73/46 |
| 4,387,502 | A | 6/1983 | Dom | 29/568 |
| 4,407,150 | A | 10/1983 | Kelly | 72/61 |
| 4,414,739 | A | 11/1983 | Kelly | 29/727 |
| 4,429,620 | A | 2/1984 | Burkhardt et al. | 91/395 |
| 4,445,201 | A | 4/1984 | Pricer | 365/154 |
| 4,450,612 | A | 5/1984 | Kelly | 72/62 |
| 4,470,280 | A | 9/1984 | Kelly | 72/61 |
| 4,483,399 | A | 11/1984 | Colgate | 166/308 |
| 4,487,630 | A | 12/1984 | Crook et al. | 75/123 |
| 4,502,308 | A | 3/1985 | Kelly | 72/58 |
| 4,505,142 | A | 3/1985 | Kelly | 72/54 |
| 4,505,612 | A | 3/1985 | Shelley, Jr. | 405/101 |
| 4,531,581 | A | 7/1985 | Pringle et al. | 166/120 |
| 4,567,631 | A | 2/1986 | Kelly | 29/157.3 |
| 4,581,617 | A | 4/1986 | Yoshimoto et al. | 346/108 |
| 4,588,030 | A | 5/1986 | Blizzard | 166/120 |
| 4,590,655 | A | 5/1986 | Javorik | |
| 4,626,129 | A | 12/1986 | Kothmann et al. | 405/43 |
| 4,697,640 | A | 10/1987 | Szarka | 166/120 |
| 4,720,113 | A * | 1/1988 | Hertz, Jr. | 277/342 |
| 4,753,444 | A * | 6/1988 | Jackson et al. | 277/342 |
| 4,807,704 | A | 2/1989 | Hsu et al. | 166/313 |
| 4,848,469 | A | 7/1989 | Baugh et al. | 166/382 |
| 4,866,966 | A | 9/1989 | Hagen | 72/75 |
| 4,883,121 | A | 11/1989 | Zwart | 166/217 |
| 4,976,322 | A | 12/1990 | Abdrakhmanov et al. | 175/57 |
| 4,997,320 | A | 3/1991 | Hwang | 408/22 |
| 5,014,779 | A | 5/1991 | Meling et al. | 166/55.7 |
| 5,052,483 | A | 10/1991 | Hudson | 166/55 |
| 5,052,849 | A | 10/1991 | Zwart | 403/300 |
| 5,156,209 | A | 10/1992 | McHardy | 166/324 |
| 5,267,613 | A | 12/1993 | Zwart et al. | 166/178 |
| 5,271,472 | A | 12/1993 | Leturno | 175/107 |
| 5,301,760 | A | 4/1994 | Graham | 175/61 |
| 5,307,879 | A | 5/1994 | Kent | 166/382 |
| 5,322,127 | A | 6/1994 | McNair et al. | 166/313 |
| 5,348,095 | A | 9/1994 | Worrall et al. | 166/380 |
| 5,366,012 | A | 11/1994 | Lohbeck | 166/277 |
| 5,409,059 | A | 4/1995 | McHardy | 166/208 |
| 5,435,400 | A | 7/1995 | Smith | 175/61 |
| 5,472,057 | A | 12/1995 | Winfree | 175/57 |
| 5,520,255 | A | 5/1996 | Barr et al. | 175/24 |
| 5,553,679 | A | 9/1996 | Thorp | 175/73 |
| 5,560,426 | A | 10/1996 | Trahan et al. | 166/120 |
| 5,636,661 | A | 6/1997 | Moyes | 137/614.2 |
| 5,667,011 | A | 9/1997 | Gill et al. | 166/295 |
| 5,685,369 | A | 11/1997 | Ellis et al. | 166/195 |
| 5,706,905 | A | 1/1998 | Barr | 176/61 |
| 5,785,120 | A | 7/1998 | Smalley et al. | 166/55 |
| 5,887,668 | A | 3/1999 | Haugen et al. | 175/79 |
| 5,901,787 | A | 5/1999 | Boyle | 166/135 |
| 5,901,789 | A | 5/1999 | Donnelly et al. | 166/381 |
| 5,904,354 | A | 5/1999 | Collins | |
| 5,924,745 | A | 7/1999 | Campbell | 285/90 |
| 5,960,895 | A | 10/1999 | Chevallier et al. | 175/27 |
| 5,979,571 | A | 11/1999 | Scott et al. | 175/61 |
| 6,021,850 | A | 2/2000 | Wood et al. | 166/380 |
| 6,029,748 | A | 2/2000 | Forsyth et al. | 166/380 |
| 6,041,858 | A * | 3/2000 | Arizmendi | 166/187 |
| 6,065,500 | A | 5/2000 | Metcalfe | 138/118 |
| 6,070,671 | A | 6/2000 | Cumming et al. | 166/381 |
| 6,098,717 | A | 8/2000 | Bailey et al. | 166/382 |
| 6,102,120 | A | 8/2000 | Chen et al. | 166/287 |
| 6,135,208 | A | 10/2000 | Gano et al. | 166/313 |
| 6,315,041 | B1 * | 11/2001 | Carlisle et al. | 166/250.17 |
| 6,325,148 | B1 | 12/2001 | Trahan et al. | 166/297 |
| 6,425,444 | B1 | 7/2002 | Metcalfe et al. | 166/387 |
| 6,446,323 | B1 | 9/2002 | Metcalfe et al. | 29/523 |
| 6,454,013 | B1 | 9/2002 | Metcalfe | 166/382 |
| 6,457,533 | B1 | 10/2002 | Metcalfe et al. | 166/381 |
| 6,510,896 | B2 | 1/2003 | Bode et al. | 166/276 |
| 6,527,049 | B2 | 3/2003 | Metcalfe et al. | 166/277 |
| 6,543,552 | B1 | 4/2003 | Metcalfe | 175/57 |
| 6,550,539 | B2 | 4/2003 | Maguire et al. | 166/380 |
| 6,571,672 | B1 | 6/2003 | Rudd | 83/36 |
| 6,571,871 | B2 | 6/2003 | Lauritzen et al. | 166/227 |
| 6,578,630 | B2 | 6/2003 | Simpson et al. | 166/207 |
| 6,585,053 | B2 | 7/2003 | Coon | 166/387 |
| 6,591,905 | B2 | 7/2003 | Coon | 166/117.6 |
| 6,629,567 | B2 | 10/2003 | Lauritzen et al. | 166/380 |
| 6,648,071 | B2 | 11/2003 | Hackworth et al. | 166/207 |
| 6,648,075 | B2 | 11/2003 | Badrak et al. | 166/381 |
| 6,662,876 | B2 | 12/2003 | Lauritzen | 166/380 |
| 6,668,399 | B2 | 12/2003 | Malstaff et al. | 5/424 |
| 6,668,930 | B2 | 12/2003 | Hoffman | 166/298 |
| 6,688,395 | B2 | 2/2004 | Maguire et al. | 166/380 |
| 6,691,789 | B2 | 2/2004 | Jackson et al. | 166/384 |

| | | | | |
|---|---|---|---|---|
| 6,695,063 | B2 | 2/2004 | Lauritzen et al. | 166/380 |
| 6,695,065 | B2 | 2/2004 | Simpson et al. | 166/384 |
| 6,698,517 | B2 | 3/2004 | Simpson et al. | 166/277 |
| 6,702,029 | B2 | 3/2004 | Metcalfe et al. | 166/378 |
| 6,702,030 | B2 | 3/2004 | Simpson | 166/380 |
| 6,708,769 | B2 | 3/2004 | Haugen et al. | 166/384 |
| 6,712,142 | B2 | 3/2004 | Simpson et al. | 166/277 |
| 2001/0040054 | A1 | 11/2001 | Haugen et al. | 175/61 |
| 2002/0145281 | A1 | 10/2002 | Metcalfe et al. | 285/206 |
| 2002/0166668 | A1 | 11/2002 | Metcalfe et al. | 166/378 |
| 2002/0189696 | A1 | 12/2002 | Simpson et al. | 138/89 |
| 2003/0037930 | A1 | 2/2003 | Coon | 166/380 |
| 2003/0037931 | A1 | 2/2003 | Coon | 166/387 |
| 2003/0042022 | A1 | 3/2003 | Lauritzen et al. | 166/277 |
| 2003/0042028 | A1 | 3/2003 | Lauritzen et al. | 166/384 |
| 2003/0056948 | A1 | 3/2003 | Cameron | 166/206 |
| 2003/0062171 | A1 | 4/2003 | Maguire et al. | 166/380 |
| 2003/0075337 | A1 | 4/2003 | Maguire | 166/380 |
| 2003/0075340 | A1 | 4/2003 | Tran et al. | 166/384 |
| 2003/0121655 | A1 | 7/2003 | Lauritzen et al. | 166/207 |
| 2003/0136561 | A1 | 7/2003 | Metcalfe et al. | 166/277 |
| 2003/0141059 | A1 | 7/2003 | Mauldin et al. | 166/277 |
| 2003/0168222 | A1 | 9/2003 | Maguire et al. | 166/380 |
| 2003/0188868 | A1 | 10/2003 | Simpson et al. | 166/298 |
| 2003/0205386 | A1 | 11/2003 | Johnston et al. | 166/382 |
| 2003/0205387 | A1 | 11/2003 | Simpson et al. | 166/382 |
| 2003/0205388 | A1 | 11/2003 | Siimpson et al. | 166/382 |
| 2003/0221840 | A1 | 12/2003 | Whitelaw et al. | |
| 2003/0226668 | A1 | 12/2003 | Zimmerman et al. | 166/387 |
| 2004/0040721 | A1 | 3/2004 | Maguire et al. | 166/380 |
| 2004/0069498 | A1 | 4/2004 | Simpson et al. | 166/380 |
| 2004/0079528 | A1 | 4/2004 | Metcalfe et al. | 166/297 |
| 2004/0094309 | A1 | 5/2004 | Maguire | 166/381 |
| 2004/0112610 | A1 | 6/2004 | Tran et al. | 166/384 |

FOREIGN PATENT DOCUMENTS

| | | | |
|---|---|---|---|
| DE | 4133802 | | 10/1992 |
| EP | 0 881 354 | A2 | 2/1998 |
| EP | 0 952 305 | A1 | 4/1998 |
| EP | 0 961 007 | A2 | 12/1999 |
| GB | 730 338 | | 5/1955 |
| GB | 792 886 | | 4/1958 |
| GB | 887150 | | 1/1962 |
| GB | 997 721 | | 7/1965 |
| GB | 1 277 461 | | 6/1972 |
| GB | 1 448 304 | | 9/1976 |
| GB | 1 457 843 | | 12/1976 |
| GB | 1 582 392 | | 1/1981 |
| GB | 2 216 926 | A | 10/1989 |
| GB | 2 320 734 | A | 1/1998 |
| GB | 2 329 918 | A | 4/1999 |
| GB | 2 313 860 | A | 1/2000 |
| GB | 2 346 400 | A | 8/2000 |
| GB | 2 347 446 | A | 9/2000 |
| GB | 2 368 866 | A | 5/2002 |
| GB | 2 379 690 | | 3/2003 |
| GB | 2 394 240 | | 4/2004 |
| WO | WO 92/01139 | | 1/1992 |
| WO | WO 93/24728 | | 12/1993 |
| WO | WO 93/25800 | | 12/1993 |
| WO | WO 94/25655 | | 11/1994 |
| WO | WO 97/21901 | | 6/1997 |
| WO | WO 98/00626 | | 1/1998 |
| WO | WO 98/32412 | | 7/1998 |
| WO | WO 99/02818 | | 1/1999 |
| WO | WO 99/06670 | | 2/1999 |
| WO | WO 99/18328 | | 4/1999 |
| WO | WO 99/23354 | | 5/1999 |
| WO | WO 00/46479 | | 8/2000 |
| WO | WO 01/18354 | A1 | 3/2001 |
| WO | WO 01/18355 | A1 | 3/2001 |
| WO | WO 01/83932 | A1 | 4/2001 |
| WO | WO 01/60545 | | 8/2001 |
| WO | WO 02/092962 | | 11/2002 |

OTHER PUBLICATIONS

International Preliminary Examination Report, International Application No. PCT/GB99/04365, dated Mar. 23, 2001.

PCT Partial International Search, International Application No. PCT/GB00/04160, dated Feb. 2, 2001.

PCT International Search Report, International Application No. PCT/GB99/04246, dated Mar. 3, 2000.

Metcalfe, P.—"Expandable Slotted Tubes Offer Well Design Benefits", *Hart's Petroleum Engineer International*, vol. 69, No. 10 (Oct. 1996), pp. 60-63—XP000684479.

The Patent Office, UK Search Report from GB 9930398.4, Dated Jun. 27, 2000.

The Patent Office, UK Search Report from GB 9930166.5, Dated Jun. 12, 2000.

GB Examination Report, Application No. 0412993.8, dated Apr. 27, 2006.

* cited by examiner

EXPANDING TUBING

CROSS-REFERENCE TO RELATED APPLICATIONS

This application is a continuation-in-part of U.S. patent application Ser. No. 10/146,357, filed May 15, 2002, now U.S. Pat. No. 6,896,052 which claims priority to GB 0111779.5, filed May 15, 2001. Each of these applications is incorporated herein by reference in its entirety.

FIELD OF THE INVENTION

This invention relates to a method of expanding tubing, and in particular to the expansion of tubing downhole. Embodiments of the invention relate to methods of obtaining relatively high expansion ratios. Further embodiments of the invention relate to packers and anchors which utilise expandable tubing.

BACKGROUND OF THE INVENTION

In recent years, the oil and gas exploration and production industry has made increasing use of expandable tubing for use as bore-lining casing and liner, in straddles, and as a support for expandable sand screens. Various forms of expansion tools have been utilised, earlier proposals including expansion dies, cones and mandrels which are pushed or pulled through tubing by mechanical or hydraulic forces. More recently, rotary expansion tools have been employed, these tools featuring rolling elements for rolling contact with the tubing to be expanded while the tool is rotated and advanced through the tubing. Each of these expansion apparatus offers different advantages, however there is a limit to the degree of expansion that is achievable using such expansion tools.

When an expandable tubular is run into a wellbore, it must be anchored within the wellbore at the desired depth to prevent rotation of the expandable tubular during the expansion process. Anchoring the expandable tubular within the wellbore allows expansion of the length of the expandable tubular into the wellbore by an expander tool. The anchor must provide adequate frictional engagement between the expandable tubular and the inner diameter of the wellbore to stabilize the expandable tubular against rotational and longitudinal axial movement within the wellbore during the expansion process.

The expandable tubular used to isolate the area of interest is often run into the wellbore after previous strings of casing are already set within the wellbore. The expandable tubular for isolating an area of interest must be run through the inner diameter of the previous strings of casing to reach the portion of the open hole wellbore slated for isolation, which is located below the previously set strings of casing. Accordingly, the outer diameter of the anchor and the expandable tubular must be smaller than all previous casing strings lining the wellbore in order to run through the liner to the depth at which the open hole wellbore exists.

Additionally, once the expandable tubular reaches the open hole portion of the wellbore below the casing liner, the inner diameter of the open hole portion of the wellbore is often larger than the inner diameter of the casing liner. To hold the expandable tubular in place within the open hole portion of the wellbore before initiating the expansion process, the expanded anchor must have a large enough outer diameter to sufficiently fix the expandable tubular at a position within the open hole wellbore before the expansion process begins.

It is among the objectives of embodiments of the present invention to provide a method of expanding tubing downhole which permits a relatively large degree of expansion to be achieved. It is also among the objectives of embodiments of the present invention to provide an anchor to support an expandable tubular used to isolate an area of interest within a wellbore prior to initiating and during the expansion of the expandable tubular. There is a need for an anchor which is small enough to run through the previous casing liner in the wellbore, capable of expanding to a large enough diameter to frictionally engage the inner diameter of the open hole wellbore below the casing liner, and capable of holding the expandable tubular in position axially and rotationally during the expansion of the length of the expandable tubular.

SUMMARY OF THE INVENTION

According to the present invention there is provided a method of expanding tubing, the method comprising the steps of:

- providing a section of expandable tubing of a first diameter; and
- axially compressing at least a portion of the tubing to induce buckling at said portion, such that said buckled portion describes a larger second diameter.

The axial compression may be induced by application of a substantially axial force, or may be induced at least in part by torsion.

The invention also relates to apparatus for expanding tubing in this manner.

The invention has particular application for use downhole, that is in drilled bores extending through earth formations, but may also be utilised in subsea or surface applications, and of course may be utilised in applications other than those related to the oil and gas industry.

By utilising the buckling of the tubing to achieve expansion, the method obviates the requirement to provide an expansion tool capable of mechanically deforming the tubing to assume the larger diameter, which has conventionally required the provision of an expansion tool it self capable of assuming an external diameter which is at least close to the larger second diameter.

The method of the invention has also been found to facilitate the attainment of relatively high expansion ratios, for example the method may be utilised to achieve expansion ratios in the region of 1.5 to 2, that is the second diameter is 1.5 to 2 times the first diameter, and indeed expansion ratios in excess of 2 are readily achievable. This greatly increases the potential applications for expandable tubing. For example, using the invention it becomes possible to achieve the degree of expansion necessary to allow expandable tubing, or a tool or device including expandable tubing, to be run through production tubing and then expanded into engagement with significantly larger diameter liner.

The tubing may take any appropriate form, and may have a solid wall at said portion, however if it is desired to achieve elevated degrees of expansion, it has been found that this is more readily achievable using slotted or apertured tubing. Most preferably, the slots are substantially axial and the ends of circumferentially adjacent slots overlap, in a similar manner to the expandable tubing produced by the applicant under the EST trade mark. In such tubing an increase in diameter is achieved primarily by deformation or bending of the webs of metal between the overlapping slot ends as the slots open. If desired, the slotted tubing may be provided in combination with an expandable sleeve which maintains the wall of the tubing fluid-tight, in one or both of the unexpanded and expanded conditions; by mounting the tubing on an appropriate mandrel it is thus possible to utilise the present invention to provide a packer. It has been widely recognised by those of skill in the art that slotted tubing contracts axially when expanded, however this has previously been viewed as a disadvantage, and it has not been recognised that this feature of the tubing may be utilised positively to facilitate expansion.

Where an elastomeric or otherwise flexible fluid-tight sleeve is provided in combination with slotted or otherwise apertured tubing, it is preferred that the sleeve is provided in combination with a support; in the absence of such support, the unsupported portions of sleeve extending across open slots or apertures may fail when subject to a differential pressure. Such support may take any appropriate form, including overlapping circumferentially extending members, which may be in the form of "leaves", arranged in an iris-like manner; the degree of overlap may reduce as the tubing is expanded, but preferably a degree of overlap remains in the expanded configuration. Alternatively, the support may take the form of structural fibres of aramid material, such as Kevlar (Trade Mark). The fibres may be provided individually, or more preferably as a weave or mesh which is capable of expanding with the tubing. Typically, the support will be provided between the tubing and the sleeve.

Of course, if the tubing initially features apertures, for example diamond-shaped apertures, axial compression of the tubing will tend to close the apertures, obviating the requirement to provide such a support arrangement.

When provided in combination with a mandrel, the tubing may be mounted in the mandrel to permit a degree of axial relative movement, to allow expansion of the tubing. Preferably, means is provided between the mandrel and the tubing for retaining said relative axial movement therebetween. Such means may take any appropriate form, for example a one-way ratchet ring. Alternatively, spaced portions of the tubing may be fixed to the mandrel and the mandrel may be telescopic or otherwise retractable to permit expansion of the tubing. A ratchet or other one-way movement retaining means may be provided in combination with such a mandrel. The mandrel may also be adapted to be extendable following retraction, to retract the extended tubing.

Preferably, a seal is provided between the mandrel and the tubing, to prevent passage of fluid between the tubing and the mandrel.

Preferably, the degree of expansion is selected to provide engagement with a surrounding structure, which may be a bore wall or existing tubing. In another embodiment, in a multilateral well, the surrounding structure may be an aperture in the wall of a parent wellbore, at the junction between the parent wellbore and a lateral wellbore; the tubing may be expanded to engage and form a snug fit with an opening in the parent wellbore casing. As the opening in the well will not be circular, and the tubing extends through the opening at an angle, it would be difficult if not impossible to achieve such a snug fit using conventional expansion techniques. Most preferably, the degree of expansion is selected to anchor or seal the tubing to the surrounding structure. To assist in anchoring the tubing, the outer surface of the tubing may carry or incorporate a gripping material or structure, such as sharp grains of relatively hard material held in a softer matrix. In one embodiment, a section of tubing may be provided with a gripping structure or arrangement, to provide an anchor, while another section of tubing is provided with a fluid-tight sleeve, to form a packer, straddle or the like.

The tubing may be pre-expanded or pre-formed before application of the compressive force thereto, the pre-expansion serving to ensure that the buckling of the tubing is initiated in the desired manner, and at a predetermined location. The pre-expansion or pre-formation may be carried out on surface, or downhole.

Alternatively, or in addition, the tubing wall may be formed or shaped in a manner to induce buckling in the desired manner. For example, a section of the wall may be relatively thin to create a recess in a wall surface, or indeed the wall may be thinned at a plurality of axially spaced locations to induce a couple in the wall on the wall experiencing axial compression.

Where the tubing is mounted on a close-fitting mandrel, it is of course not possible for the tubing to buckle to assume a smaller diameter configuration.

The portion of the tubing which is expanded may be of limited length, or may be of an extended length, although the buckling of the tubing generally becomes more difficult to control as the length of the portion to be buckled increases.

The compressive force may be applied to tubing by any convenient method, including simply applying weight to the tubing. Alternatively, a compression tool may be provided within the tubing and have portions engaging the tubing to either end of the portion to be compressed, which portions are brought together to expand the tubing; for simplicity, one portion is likely to be fixed and the other portion movable. This method offers the advantage that the tubing need not be anchored or otherwise fixed in the bore for the expansion process to be initiated. The compression tool may be actuated by any suitable means, and may be fluid pressure actuated or may be actuated by an electric motor rotating a screw which draws the engaging portions together. The tool and tubing may thus be mounted on a support which need not be capable of transmitting a substantive axial compression force, such as coil tubing.

In a further aspect of the present invention, the expandable system includes an expandable tubular which is predisposed to deform radially outward to contact the wellbore in response to a compressive axial load. The expandable system further includes a setting tool which applies the compressive load to the expandable tubular.

In operation, the setting tool is releasably attached to the expandable tubular during run-in of the expandable system. The expandable tubular is compressed axially by the setting tool, deforming a portion of the expandable tubular radially outward towards the wellbore to anchor the expandable system. The releasable attachment is released, and the setting tool is removed from the wellbore. An expander tool is then run into the wellbore to expand the remaining portion of the expandable tubular along its length.

In yet a further aspect of the present invention, an expander tool is attached to a setting tool. The setting tool is releasably attached to an expandable tubular during run-in of the expandable system. The setting tool compresses the expandable tubular axially, deforming a portion of the expandable tubular radially outward towards the wellbore to anchor the expandable system, including the expandable tubular and the setting tool. The releasable attachment is released, and the expander tool is then movable axially and/or rotationally to expand the remaining length of the expandable tubular.

BRIEF DESCRIPTION OF THE DRAWINGS

These and other aspects of the invention will now be described, by way of example, with reference to the accompanying drawings, in which.

DETAILED DESCRIPTION OF THE DRAWINGS

Figure 1:
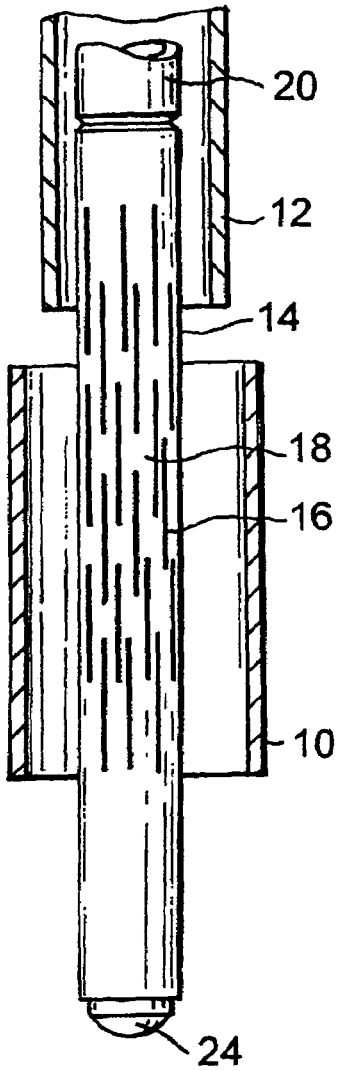
FIGS. 1, 2 and 3 are part-sectional schematic view of stages in an expansion method in accordance with an embodiment of the present invention.
Figure 2:
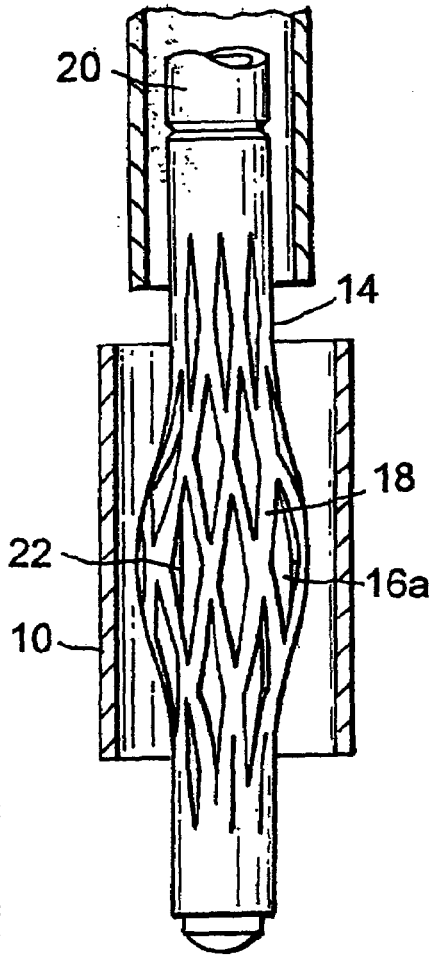
Figure 3:
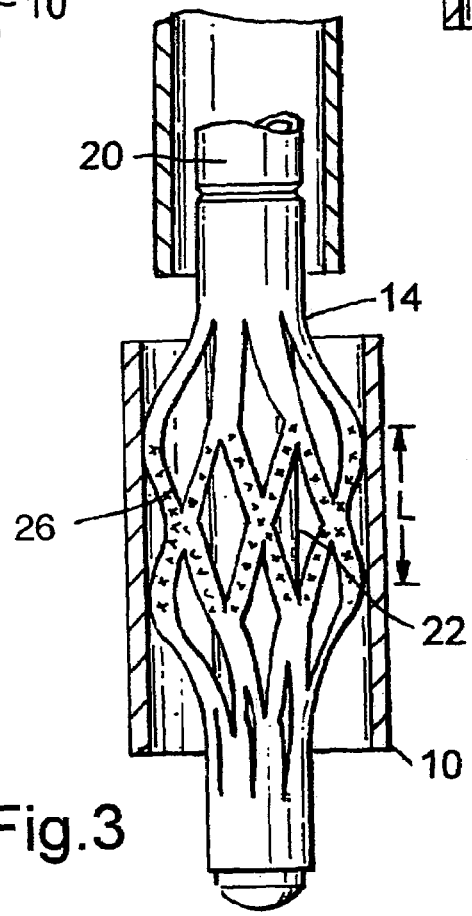

FIGS. 1, 2 and 3 of the drawings illustrate the process of expanding a section of tubing downhole to create an anchor. The Figures show a number of elements of a lined oil or gas production bore (those of skill in the art will recognise that many other elements have been omitted, in the interest of clarity). In particular, the Figures show a 7" liner 10 (internal diameter (i.d.) 6.2") and the lower end of a string of production tubing 12 (i.d. 3.75"). A section of slotted tubing 14 (outer diameter (o.d.) 2.875") has been run into the bore through the production tubing 12 and positioned within the liner 10. The wall of the tubing 14 includes a plurality of rows of axial slots 16, the ends of the slots 16 in adjacent rows overlapping such that there are relatively thin webs of material 18 between the slot ends.

The slotted tubing 14 is mounted to the end of a running string 20, and a telescopic running tool 22 extends through the tubing 14, the end of the tool 22 featuring a shoe 24 which engages and extends from the end of the tubing 14.

In use, the tubing 14 is run into the bore to the location as illustrated in FIG. 1, in which the shoe 24 engages the end of the bore. If weight is then applied to the running string 20, this weight is also applied to and tends to compress the slotted tubing 14. In response to this compression, the wall of the tubing 14 buckles, as illustrated in FIG. 2, this buckling being accommodated primarily by bending of the webs 18 between the slot ends, such that the slots 16 open to create diamond-shaped apertures 16*a*. The buckling of the tubing 14 results in the diameter described by the tubing increasing, as well as the length of the tubing 14 decreasing. Continued compression of the tubing 14 produces further buckling and expansion, until the initially buckled portion of the tubing 14 contacts and is restrained against further expansion by the liner 10. Still further compression of the tubing 14 results in adjacent portions of the tubing expanding until they too engage the liner 10. As may be seen from FIG. 3, this results in the tubing 14 engaging a section of the liner 10, of length "L".

To minimise the possibility of relative axial movement between the expanded tubing 14 and the liner 10, the tubing 14 carries gripping elements in the form of small, sharp particles of relatively hard material, in the form of carbide chips 26.

It is apparent that the tubing 14 has undergone a significant degree of expansion, from an initial o.d. of 2.875" to an expanded o.d. of 6.2", that is an expansion ratio in excess of two. Clearly, it would be difficult to obtain such a degree of expansion utilising a conventional expansion tool.

As the tubing 14 has undergone plastic deformation, when the applied weight is removed from the running string 20 the buckling and expansion of the tubing 14 is retained, and the expanded tubing 14 is anchored to the liner 10.

The running string 20 is then uncoupled from the tubing 14, which remains in the liner 10 to serve as an anchor for a tool or device subsequently run into the bore and coupled to the tubing 14.

If subsequently it is desired to remove the tubing 14 this may be achieved by running an appropriate tool into the tubing 14, and which tool may then be actuated to axially extend the tubing 14, such that the tubing 14 contracts radially, out of engagement with the liner 10.

Figure 4:
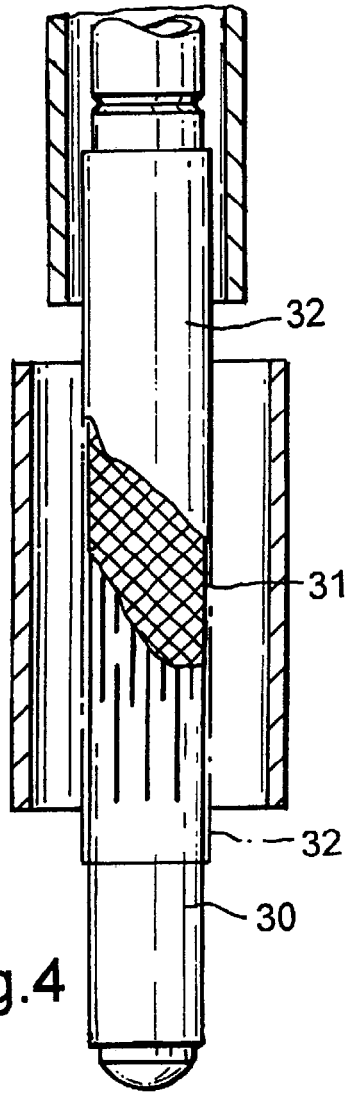
FIG. 4 is a part-sectional schematic view of expansion apparatus in accordance with another embodiment of the present invention.

FIG. 4, which corresponds essentially to FIG. 1, illustrates slotted expandable tubing 30 provided with an elastomeric sleeve 32 (shown in chain-dotted outline), which maintains the tubing 30 fluid-tight in both the expanded and unexpanded conditions. The expanded tubing may thus act as, for example, a straddle or even a packer, as described below.

As is apparent from FIG. 3 above, expanded slotted tubing features diamond-shaped apertures; the sleeve 32 extends across these apertures and, in the absence of internal support, an external pressure may result in failure of the sleeve. Accordingly, a support structure comprising an aramid weave 31 is provided between the tubing 30 and the sleeve 32. The weave 31 behaves in a somewhat similar fashion to the tubing 30 on expansion, in that as the weave diameter increases, the weave length decreases, in concert with the tubing 30. In other embodiments, the support may take other forms, for example of a somewhat similar form to the strips of metal featured on the exterior of inflated element packers.

Figure 5:
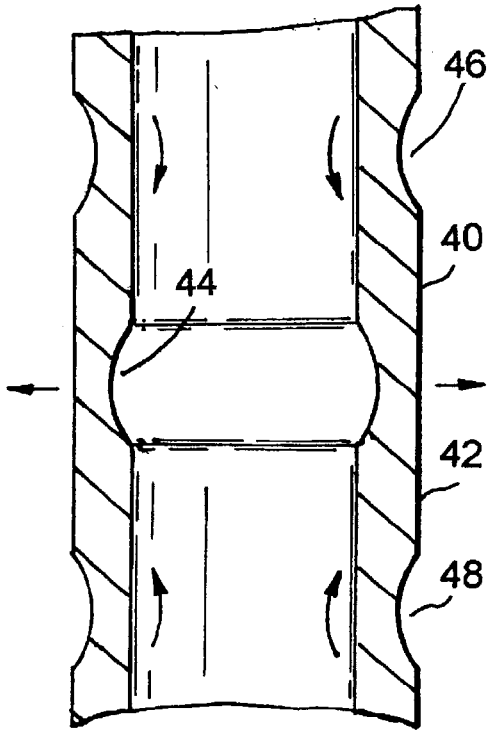
FIG. 5 is a sectional view of a wall of tubing in accordance with a further embodiment of the present invention.

FIG. 5 illustrates a sectional view of a wall of a section of expandable tubing 40 in accordance with a further embodiment of the present invention. It will be noted that the tubing wall 42 is relatively thin at three locations, that is a central location 44, and at locations 46, 48 above and below the central location 44.

On the wall 42 being subject to a compressive force, the wall configuration at the central location 44 creates a bias tending to induce radially outward buckling. Furthermore, the thinning at the upper and lower locations 46, 48 creates a bias inducing a couple further serving to induce radially outward buckling at the central location 44.

By providing tubing 40 with the illustrated wall configuration, the running tool for the tubing 40 may be simplified, as it is not necessary to mechanically induce the desired buckling configuration.

Figure 6:
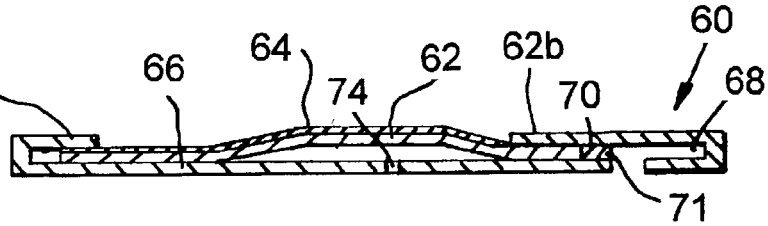
FIGS. 6 and 7 are schematic sectional views of a packer arrangement in accordance with a still further embodiment of the present invention.
Figure 7:
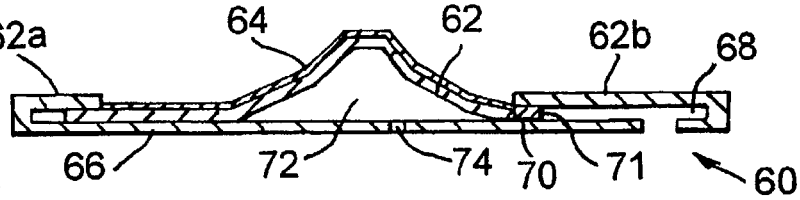

FIGS. 6 and 7 are schematic sectional views of a packer arrangement 60 in accordance with a still further embodiment of the present invention. The packer 60 includes a section of expandable slotted tubing 62 having an elastomeric sleeve 64 mounted thereon, in a similar manner to the embodiment of FIG. 4. However, the tubing 62 is mounted on a tubular mandrel 66, with one end of the tubing 62*a* being fixed and sealed to the mandrel 66, and the other end of the tubing 62*b* being sealed to but axially movable relative to the mandrel 66. The tubing end 62*b* is in fact located in an annular chamber 68 which contains a piston 70 having one face in contact with the tubing end 62*b* and the other face exposed to internal tubing pressure. The piston 70 carries a one-way ratchet ring 71, which engages a corresponding ratchet face on the mandrel 66.

The packer 60 may thus be run into a bore in the configuration as illustrated in FIG. 6. If an elevated pressure is then applied to the interior of the mandrel 66, the piston 70 is urged to compress and buckle the tubing 62, such that the sleeve 64 is brought into sealing contact with the surrounding bore wall.

As noted above, to assist in maintaining the extended form of the tubing 62, the piston 70 includes a ratchet ring 71, such that on bleeding off the internal pressure the piston 70 is retained in the advanced position. In addition, the packer is arranged such that the volume 72 between the extended tubing 62 and the mandrel 66 fills with incompressible bore fluid, via a flow port 74 provided with a one-way valve, such that the fluid becomes trapped in the volume 72 on the tubing 62 reaching its fully extended configuration. In another embodiment, the piston may be coupled to a sleeve which closes the port on the piston reaching its advanced position.

Figure 8:
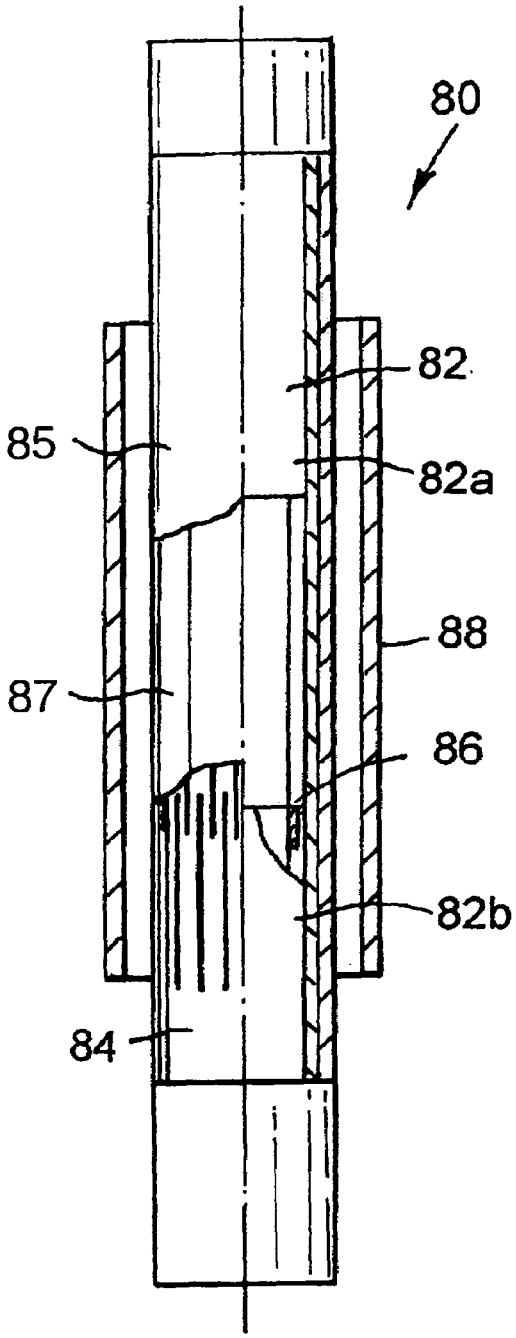
FIGS. 8 and 9 are schematic part-sectional views of a packer arrangement in accordance with a yet further embodiment of the present invention.
Figure 9:
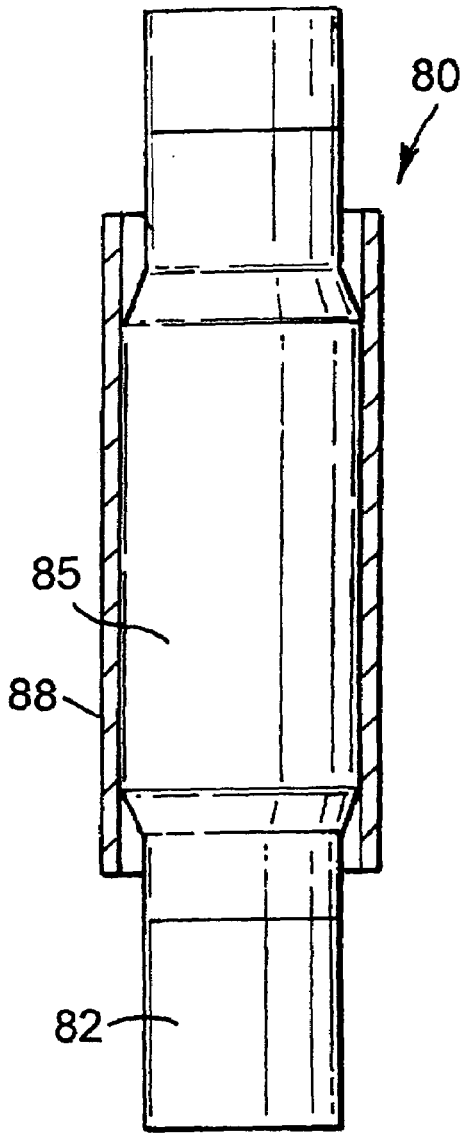

FIGS. 8 and 9 are schematic sectional views of a packer arrangement 80 in accordance with a yet further embodiment of the present invention. The packer 80 comprises a telescopic mandrel 82 having mounted thereon a section of expandable slotted tubing 84 surrounded by an elastomeric sleeve 85, with sleeve-supporting strips of metal 87 provided between the tubing 84 and the sleeve 85.

As noted above, the mandrel 82 is telescopic and comprises two principal parts 82*a*, 82*b*, each end of the tubing 84 being fixed and sealed to a respective part. Further, a ratchet arrangement 86 is provided between the parts 82*a*, 82*b*, which arrangement 86 permits contraction of the mandrel 82, but resists extension of the mandrel.

In use, the packer 80 is run into a wellbore on an appropriate running tool, in this example into a section of casing 88, and the mandrel 82 axially contracted to buckle the tubing 84, such that a portion of the surface of the sleeve 86 is brought into sealing contact with the surrounding casing 88.

If it is subsequently desired to release the packer 80, the ratchet 86 may be sheared out, the mandrel 82 extended, and the tubing 84 returned to its original, cylindrical configuration.

Figure 10:
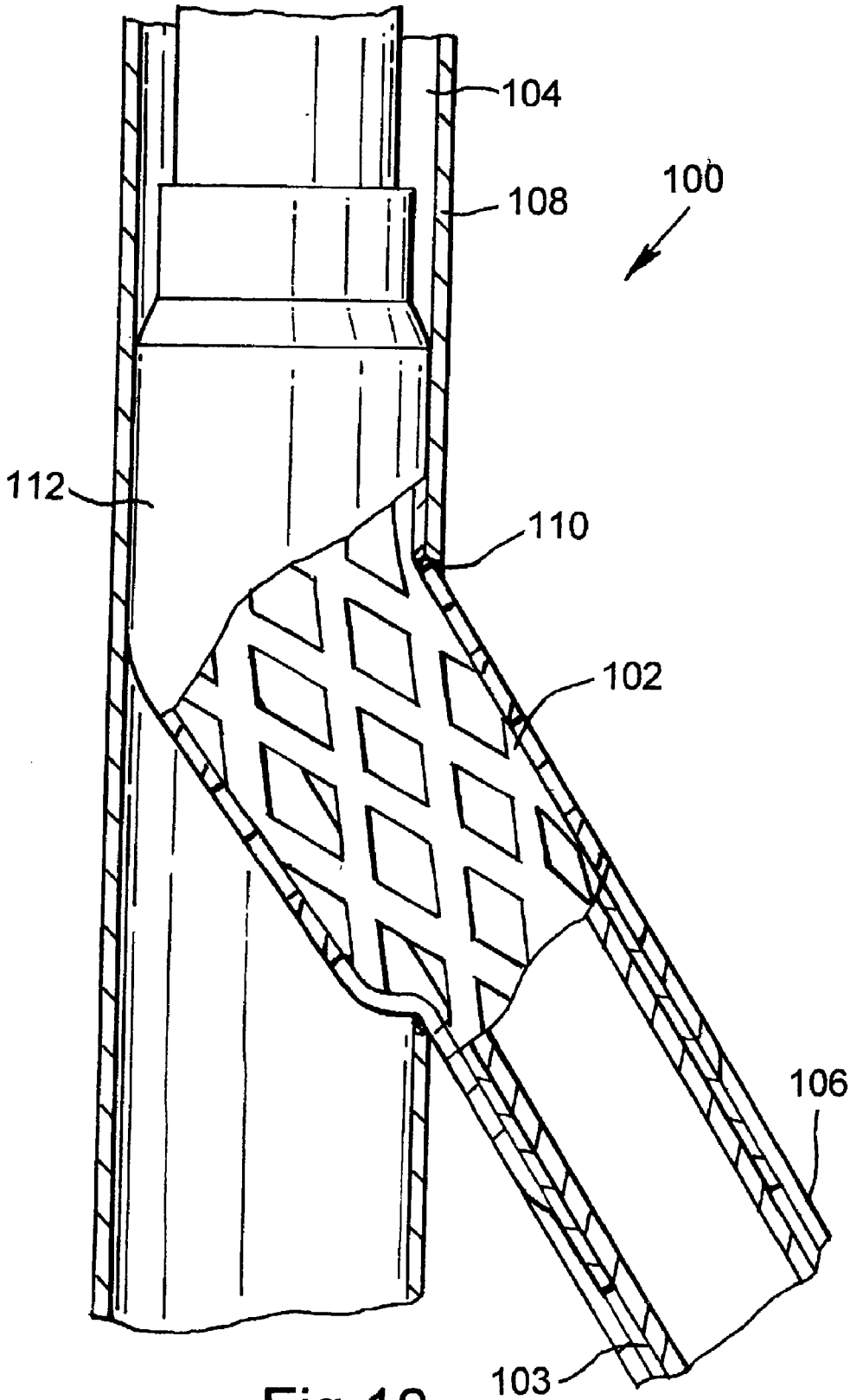
FIG. 10 is a schematic sectional view of a multilateral well junction comprising tubing which has been expanded in accordance with a method of an embodiment of the present invention.

FIG. 10 is a schematic sectional view of a multilateral well junction 100 comprising tubing 102 which has been expanded in accordance with a method of an embodiment of the present invention. The tubing 102 is mounted on a tubular mandrel 103.

The tubing 102 is slotted and positioned to extend between a parent wellbore 104 and a lateral wellbore 106. The parent wellbore 104 is lined with casing 108 which has been milled to create the exit portal 110 into the lateral wellbore 106.

The tubing 102 carries a supported and sheathed elastomeric sleeve 112 and is run into the junction 100 in unexpanded form. The tubing 102 is then axially compressed such that at least the portion of the tubing 102 located in the aperture 110 buckles and extends radially to engage the walls of the aperture 110. The resulting snug fit with the walls of the aperture serves to locate the tubing 102, and the mandrel 103 on which the tubing 102 is mounted, securely in the portal 110, and the nature of the expansion is such that the tubing 102 will tend to expand until the tubing engages the surrounding portal wall; it is immaterial that portal 110 is not truly circular (typically, the aperture will be oval).

The tubing 102 and mandrel 103 may then serve to assist in positioning and sealing casing which is subsequently run into and cemented in the lateral wellbore 106, and to assist in the creation of a hydraulic seal between the wellbores 104, 106.

Figure 11:
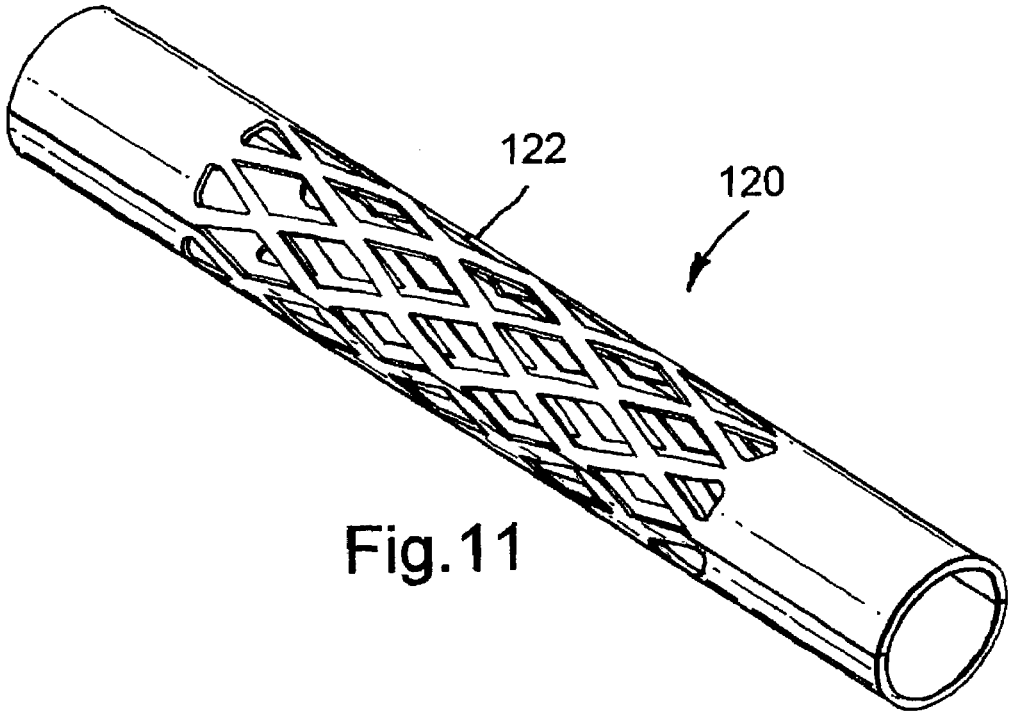
FIG. 11 is a perspective view of expandable tubing in accordance with an alternative embodiment of the present invention.
Figure 12:
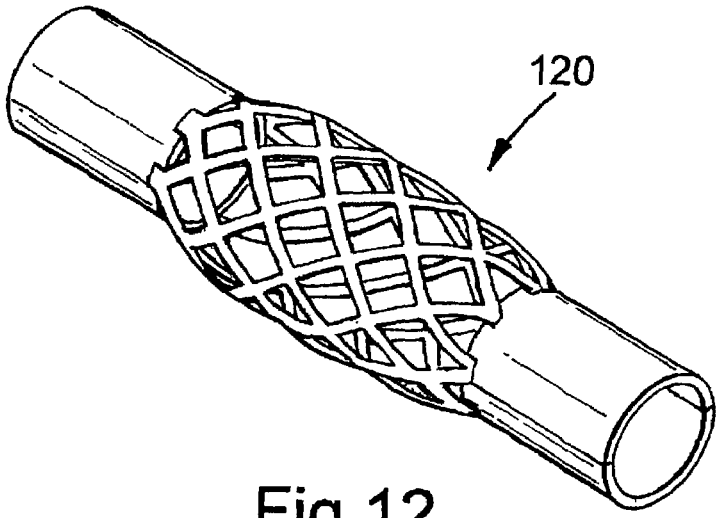
FIGS. 12 to 16 illustrate steps in the expansion of the tubing of FIG. 11.
Figure 13:
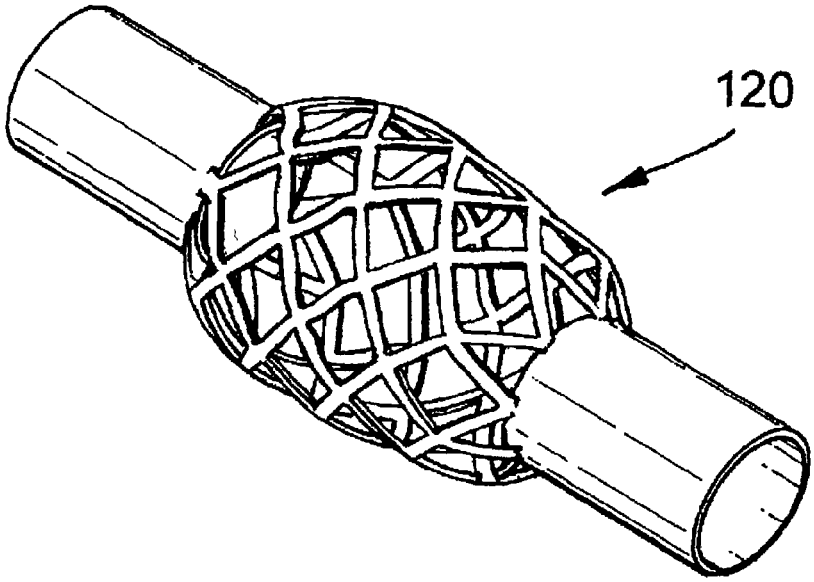
Figure 14:
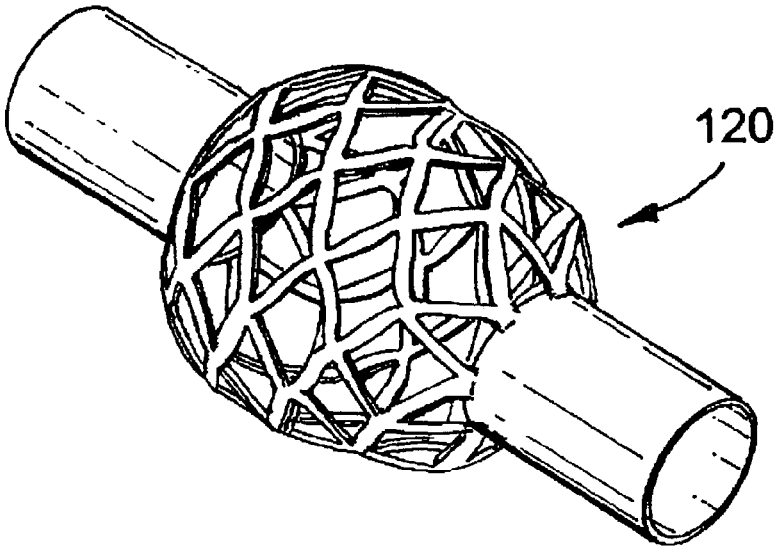
Figure 15:
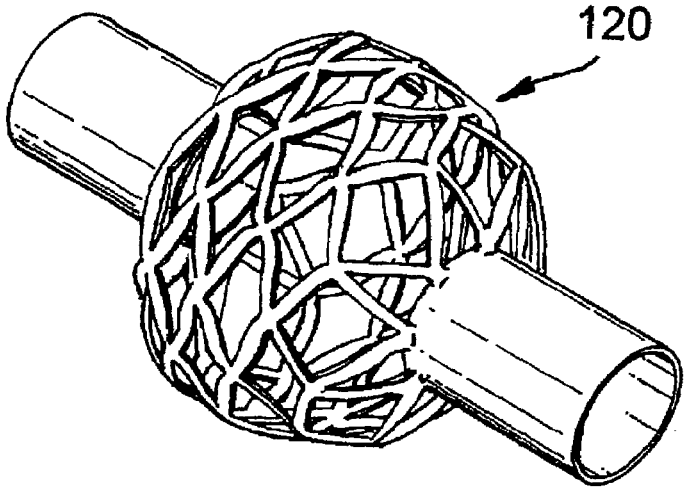

FIGS. 11 to 16 relate to an alternative embodiment of the present invention in which the expandable tubing 120, shown in unexpanded condition in FIG. 11, initially defines a plurality of diamond-shaped apertures 122. The illustrated tubing 120 is initially 3" diameter, and FIGS. 12 to 16 illustrate the tubing when subject to axial displacement of 1", 2", 3", 4" and 5", respectively.

Figure 16:
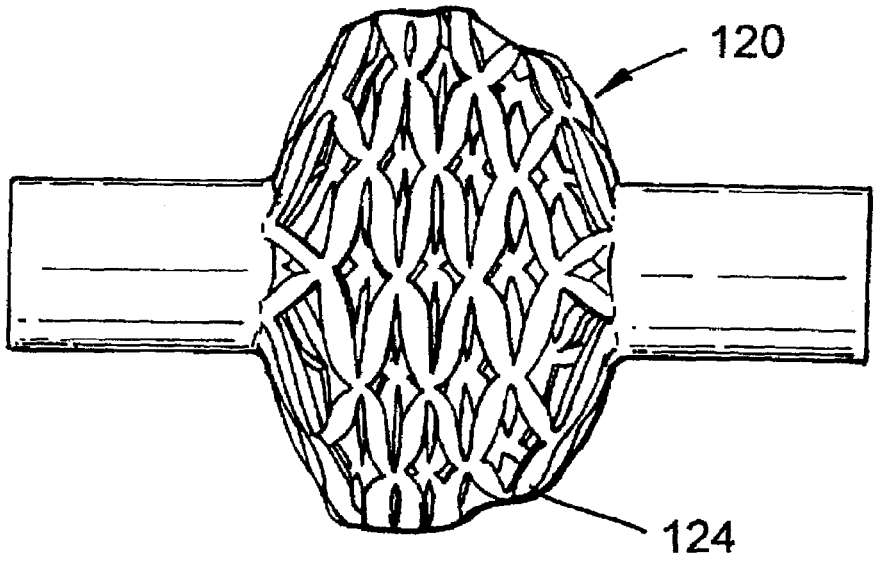

It will be observed that the diameter of the expanded tubing portion 124 of FIG. 16 is almost three times the diameter of the original tubing, but those of skill in the art will appreciate that an expansion ratio which is even a fraction of this may be useful in many applications. Furthermore, the manufacture of the apertured tubing 120 is generally more straightforward than the manufacture of the slotted tubing: whereas the slots must be cut, typically by water-jetting or laser, the apertures may be punched from the tubing. The apertured tubing 120 may of course be used in place of slotted tubing in any of the above-described embodiments of the invention.

Figure 17:
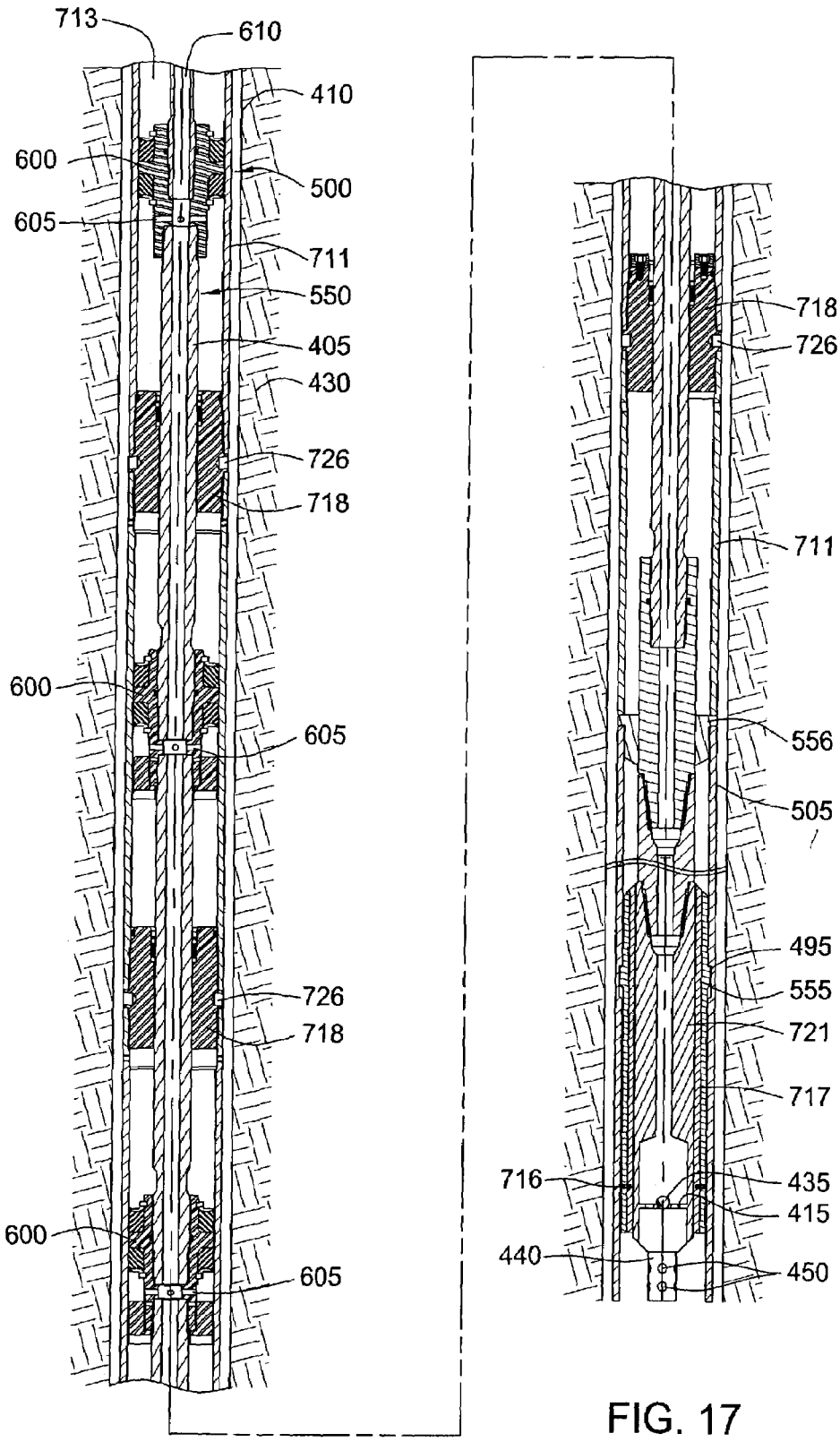
FIG. 17 is a cross-sectional view of an expandable system of the present invention in the run-in configuration. The expandable system includes an expandable tubular and a setting tool releasably attached.

FIG. 17 is an alternate embodiment of the present invention shown in the run-in configuration. An expansion system 500 is disposed within a wellbore 410. The expansion system 500 includes a setting tool 550 and an expandable tubular 505.

The expandable tubular 505 is predisposed prior to its insertion into the wellbore 410 so that a portion of the expandable tubular 505 deforms radially outward towards the wellbore 410 relative to the remaining portions of the expandable tubular 505 in response to a compressive axial load. This predisposition may be accomplished by heat treating the expandable tubular 505 prior to placing it into the wellbore 410. The heat treatment serves to vary the force required to deform the expandable tubular 505 along the length of the expandable tubular 505 by varying the modulus of elasticity of the tubular material along its length. Preferably, the heat treatment progressively modifies the tensile strength of the expandable tubular 505 so that the anchor portion of the expandable tubular 505 is the easiest to deform by compressive force, while the portions of the expandable tubular 505 above and below the anchor portion of the expandable tubular 505 become more difficult to deform by compressive force. For example, consider an expandable tubular which initially has a tensile strength of 80,000 psi. The anchor portion, which may be located at an upper portion or a lower portion of the expandable tubular, is heat treated to possess the lowest tensile strength of about 20,000 psi. When the anchor portion is the upper portion, the upper end of the expandable tubular may remain at a tensile strength of about 80,000 psi. Then, progressing downward along the length of the expandable tubular, the expandable tubular is heat treated to decrease in tensile strength at the anchor portion of the expandable tubular to, e.g., about 20,000 psi. The lower end of the anchor portion may increase in tensile strength to about 40,000 psi, for example. The expandable tubular may then increase in tensile strength along its lower portion to 60,000 psi, then the expandable tubular may remain unaltered by heat treatment at its lowermost portion and retain a tensile strength of about 80,000 psi. In this example, the anchor portion of the expandable tubular 505 experiences the most deformation outward and exhibits the maximum frictional contact with the wellbore 410 to anchor the expandable system 500 axially and rotationally within the wellbore 410.

Alternatively, the same progressive deformation effect may be achieved by varying the wall thickness of the expandable tubular 505 so that the thickest portion of the expandable tubular 505 is the hardest to deform, while the thinnest portion of the expandable tubular is the easiest to deform. The thinnest portion of the expandable tubular 505 would experience the maximum contact with the inner diameter of the wellbore 410.

Heat treatment of portions of the expandable tubular may be accomplished by supplying heat by means of an induction coil to the desired portions. Alternatively, the heat may be supplied to treat portions of the expandable tubular by heating a mantel located on the expandable tubular, thus providing a conductive source of heat to the expandable tubular portion. Any other method known by those skilled in the art of treating tubulars to modify tensile strength or yield strength of the tubulars may be used with the present invention.

The process of heat treating a typical expandable tubular involves first austentizing the tubular. Austentizing is the step of the process in which the tubular is hardened by gradually heating the tubular to above its critical temperature. After the tubular is austentized, the temperature of the heat supplied to the tubular is drastically reduced. At this point, the tubular possesses high strength but also exhibits brittleness.

The brittle character of the tubular may cause the tubular to break upon expansion; therefore, the next step in the process is typically tempering the expandable tubular to reduce brittleness. After the tubular is cooled down, it is again heated. This time, the tubular is heated to a temperature below critical temperature. The temperature of the heat supplied to the tubular is gradually reduced. An expandable tubular at this step in the process may possess a yield strength of about 90,000 psi, a tensile strength of about 110,000 psi, and a percent ductility or percent elongation of about 20%.

In the present invention, a portion (or multiple portions) of the expandable tubular 505 of the present invention may be further heat treated to modify the yield strength, tensile strength, and/or percent elongation of the expandable tubular 505. A "tempering back" process is performed to soften portions of the expandable tubular. The tempering back process includes a further austentizing process followed by cooling the expandable tubular. After completion of the tempering process, the expandable tubular may have a yield strength of about 65,000 to 75,000 psi, a tensile strength of around 90,000 psi, and/or a percent elongation or percent ductility of about 26%. If the cooling of the expandable tubular is slow so that the power of the heat source is decreased rather than turned completely off, which results in a high temperature process with a controlled slow cool, the expandable tubular may be annealed so that it is soft and ductile. An annealed expandable tubular may have a yield strength of 45,000 to 55,000 psi, a tensile strength of about 75,000 psi, and/or a percent elongation or percent ductility of about 30%. Therefore, the heat treatment process of the present invention decreases the yield strength and tensile strength of the tubular, while simultaneously increasing the ductility of the tubular. Thus, the portion of the tubular which is heat treated is easier to deform than the portion of the tubular which is not heat treated. Furthermore, varying the amount of heat treatment supplied to a portion of the tubular causes the tubular to deform at predetermined locations on the tubular.

The expandable tubular 505 is preferably a solid tubular-shaped body constructed of steel, but may also be slotted or perforated. The perforations may be round, rectangular, or square-shaped, and the rectangular or square perforations may possess rounded edges. Preferably, the outer diameter of the tubular body is provided with a rough surface such as by knurling, coating the outer diameter with rubber, or providing spikes on the outer diameter. Knurling involves forming shallow, rough marks on the outer diameter of the expandable tubular 505. Altering the outer diameter of the expandable tubular 505 by providing the outer diameter of the tubular body with knurling, spikes, or rubber coating produces a rough surface on the expandable tubular 505 with which the expandable tubular 505 bites into a formation 430 and grippingly engages the formation 430. Thus, the rough outer diameter provides increased frictional contact with the formation 430, thereby allowing the portion of the expandable tubular 505 to serve as a more effective anchor for the expandable system 500.

The setting tool 550 comprises a working string 405 with an opening 610 therethrough which allows fluid flow. The working string 405 has one or more pistons 600 and piston valves 605 connected thereto, preferably by threaded connections. Any number of pistons 600 and corresponding piston valves 605 may be connected to the working string 405 according to the amount of compressive force required to pull the expandable tubular 505.

The setting tool 550 further includes a tubular member 711 surrounding the working string 405, so that the each piston 600 is located within an annular space 713 between the tubular member 711 and the working string 405. A connecting member 556 is threadedly connected to the working string 405 between a lower end of the tubular member 711 and an upper end of the expandable tubular 505. The connecting member 556 aids in transmitting an axial load from the setting tool 550 to the expandable tubular 505. Also disposed within the annular space 713 above each piston 600 is a stop 718, which is rigidly connected to the tubular member 711, preferably with pins 726. The stop 718 represents the maximum stroke of each piston 600 through the annular space 713.

A collet, including collet fingers 555 releasably connected to a sleeve 717, is disposed on the working string 405 to releasably connect a lower portion of the setting tool 550 to the expandable tubular 505 by engaging a groove 495 in the expandable tubular 505. The collet fingers 555 are releasably connected by a releasable connection 716, preferably a shearable member such as a pin, to the sleeve 717. The sleeve 717 is disposed within the collet fingers 555 and biases the collet fingers 555 outward radially so that the collet fingers 555 engage the groove 495 upon run-in of the expandable system 500.

Connected at a lower end of the working string 405, preferably threadedly connected, is a tubular body 721 with a ball retaining assembly 415 disposed therein. The longitudinal bore within the tubular body 721 may be of any size which is capable of accommodating a ball 435 (see below) therethrough, and may increase or decrease in size within various portions of the tubular body 721. The ball retaining assembly 415 comprises two shearable members which are connected to the inner diameter of the tubular body 721 and face one another within the tubular body 721. A ball catcher 440 is disposed below the ball retaining assembly 415 and connected to the ball retaining assembly 415. The ball catcher 440 is a tubular-shaped body with holes 450 therein which allow fluid communication from the inner diameter of the tubular body 721 into the wellbore 410. A ball 435 is disposed within the ball retaining assembly 415 in FIG. 1.

In operation, the expandable tubular 505 is heat treated so that the portion of the expandable tubular 505 intended to serve as the anchor for the expandable system 500 requires the least compressive force to deform outward. The expandable system 500 is run into the wellbore 410 in the configuration shown in FIG. 17. Specifically, before run-in, the lower portion of the working string 405 is inserted into the expandable tubular 505. The collet fingers 555 connect the setting tool 550 and the expandable tubular 505 upon run-in of the expandable system 500.

Once the expandable system 500 is run into the wellbore 410 to the desired depth at which to anchor the expandable tubular 505, the ball 435 is dropped into the setting tool 550 through the working string 405 and initially retained within the ball retaining assembly 415, as shown in FIG. 17. Fluid 445 is introduced into the setting tool 550 through the working string 405. The ball 435 plugs the opening 610 in the working string 405 so that fluid pressure builds up within the setting tool 550. Fluid 445 is thus forced through the piston valves 605 to actuate the pistons 600 through hydraulic force. The fluid 445 behind the pistons 600 forces the pistons 600 to translate axially upward into the annular space 713. The pistons 600 also move upward relative to the tubular member 711. Because the working string 405 is rigidly connected to the pistons 600 and the working string 405 is also releasably connected to the expandable tubular 505, the expandable tubular 505 is pulled upward by the movement of the pistons 600 in relation to the tubular member 711.

Figure 18:
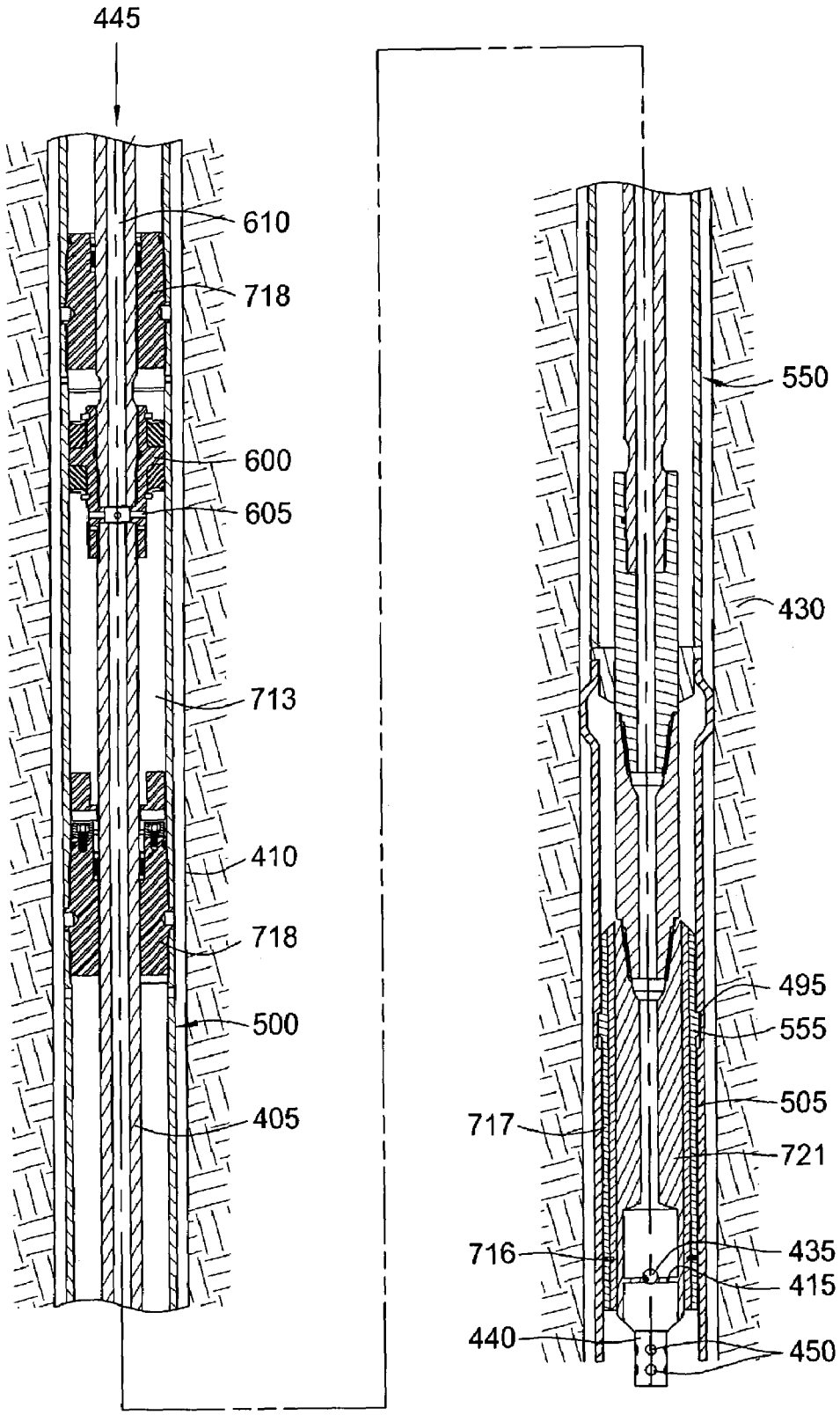
FIG. 18 is a cross-sectional view of the expandable system of FIG. 17, with a portion of the expandable tubular expanded into contact with the wellbore.

The expandable tubular 505 is moved upward so that the upper end of the expandable tubular 505 is stopped by the connecting member 556 and the lower end of the tubular member 711. At this point, the pistons 600 continue to pull the expandable tubular 505 upward. The expandable tubular 505 is thus compressed between the connecting member 556 and the groove 495 which has the collet fingers 555 located therein. The compressive force exerted on the expandable tubular 505 deforms the expandable tubular 505 outward radially toward the formation 430. The portion of the expandable tubular 505 which was previously heat treated to require the least compressive force to expand outward contacts the wellbore 410, and the amount of radial deformation of the expandable tubular 505 decreases while moving progressively axially along the expandable tubular 505 from that portion. The most deformable portion of the expandable tubular 505 serves as the anchor of the expandable tubular 505 to the wellbore 410. FIG. 18 shows the anchored expandable tubular 505.

Figure 19:
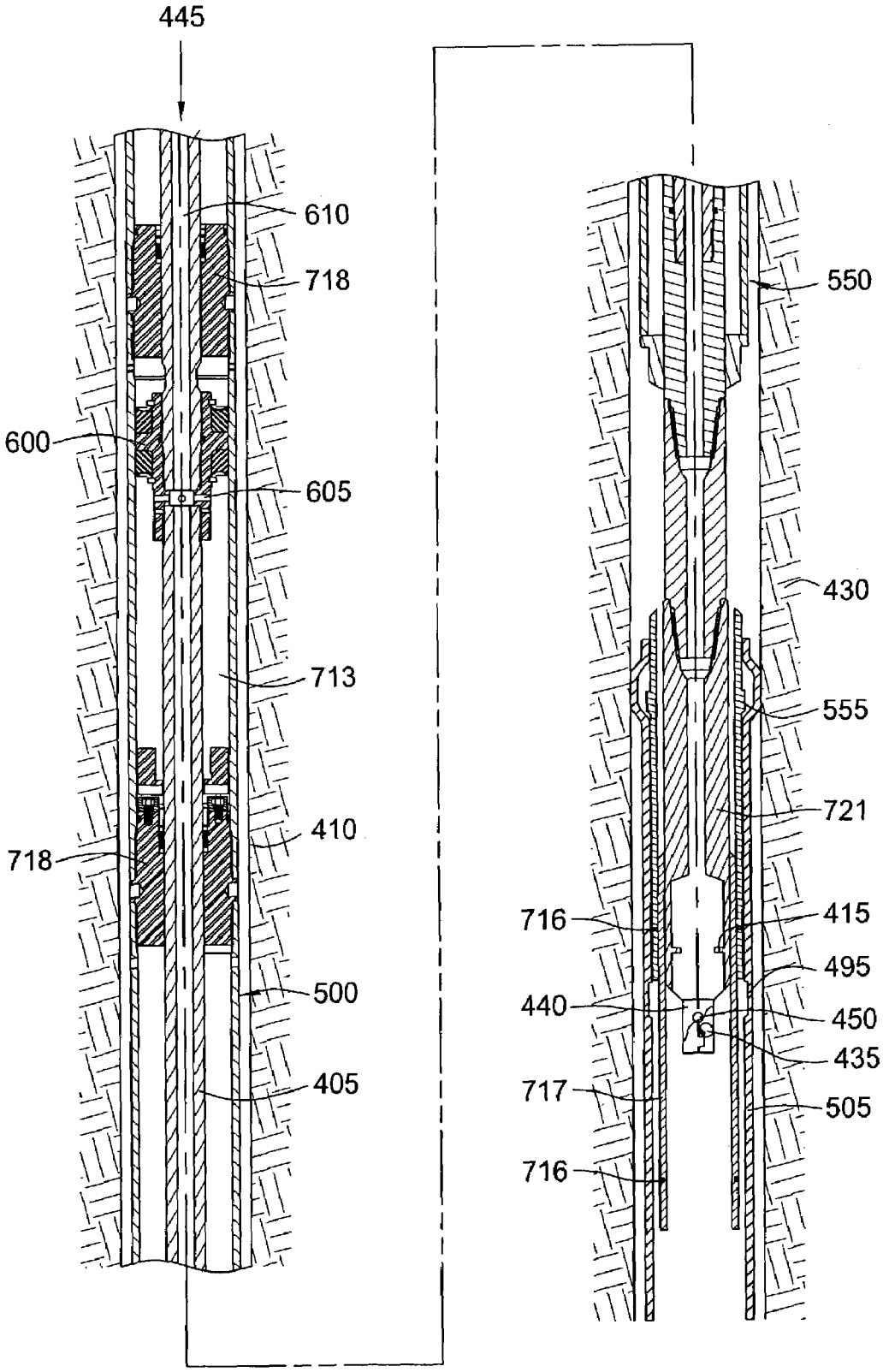
FIG. 19 is a cross-sectional view of the expandable system of FIG. 17, with the setting tool disengaged from the expandable tubular.

The stops 718 are located in the annular space 713 so that they dictate the extent of travel of the pistons 600, thus determining the length of the expansion process. After the expandable tubular 505 is compressed so that it is anchored against the inner diameter of the wellbore 410 as shown in FIG. 18, fluid pressure is increased within the setting tool 550 so that the sleeve 717 is released from the collet fingers 555 by shearing of the releasable connection 716. As the sleeve 717 moves downward, the collet fingers 555 move radially inward to release from the groove 495 within the expandable tubular 505. The setting tool 550 with the collet fingers 555 attached thereto is then moveable axially and radially in relation to the expandable tubular 505, while the expandable tubular 505 is rotationally and axially fixed within the wellbore 410 by frictional force created by the anchor. FIG. 19 shows the collet fingers 555 released from the expandable tubular 505 and the expandable tubular 505 remaining anchored within the wellbore 410.

Fluid pressure is then further increased to force the ball 435 through the ball retaining assembly 415, so that the shearable members of the ball retaining assembly 415 are sheared. The ball 435 is forced into the ball catcher 440. Fluid pressure is relieved through the holes 450 in the ball catcher 440.

Figure 20:
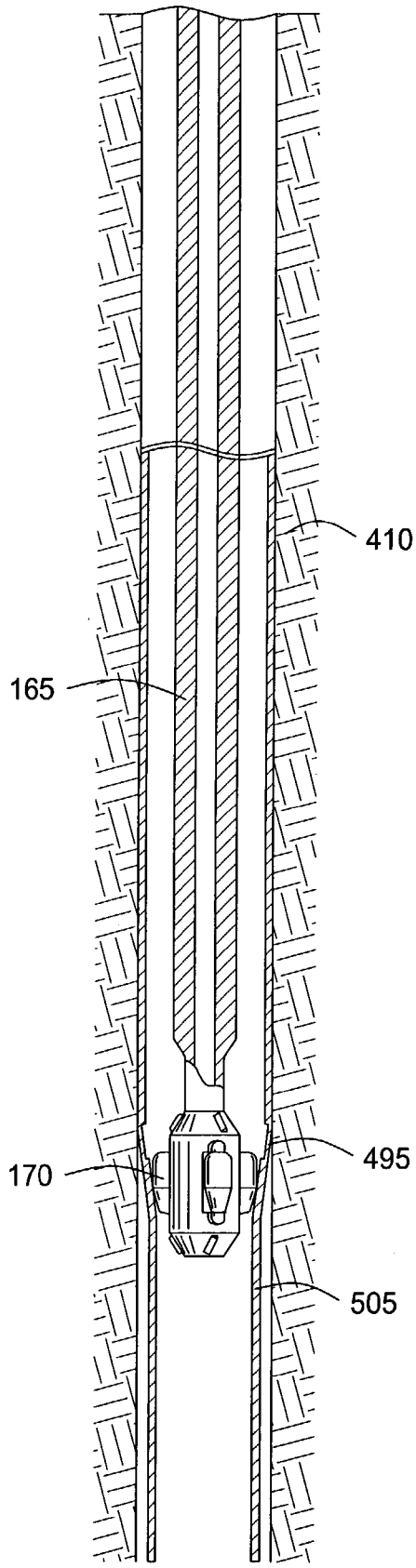
FIG. 20 is a cross-sectional view of the expandable tubular of FIG. 17 during expansion of remaining portions of the expandable tubular by an expander tool.

Next, the setting tool 550 and the collet fingers 555 are retrieved from the wellbore 410. An expander tool 170 is then run into the wellbore 410 on a working string 165 to expand the remaining portion of the expandable tubular 505 into contact with the wellbore 410. The expander tool 170 may be coupled to a motor (not shown) to impart rotational movement to the expander tool 170. The motor is disposed on the working string 165, and it may be hydraulically actuated by fluid pumped through the working string 165 which extends rollers on the expander tool 170 radially outward to expand the expandable tubular 505. Although a rotary expander tool is depicted herein for used with the present invention, other types of expander tools such as cone-shaped mandrels are also applicable according to aspects of the present invention. U.S. patent application Ser. No. 10/328,708, entitled "Expandable Sealing Apparatus" and filed on Dec. 23, 2002, which is herein incorporated by reference in its entirety, describes the operation of an expander tool which may be used in conjunction with the present invention. The expander tool 170 translates upward and downward axially and rotationally to deform the remaining length of the expandable tubular 505, including the top portion of the expandable tubular 505, into contact with the wellbore 410. The designated portion of the wellbore 410 is thus contacted by the outer diameter of the expandable tubular 505 along the length of the expandable tubular 505. FIG. 20 shows the expander tool 170 expanding the length of the expandable tubular 505 against the inner diameter of the wellbore 410. Upon completion of the expansion of the length of the expandable tubular 505, the expander tool 170 is retrieved from the wellbore 410.

Figure 21:
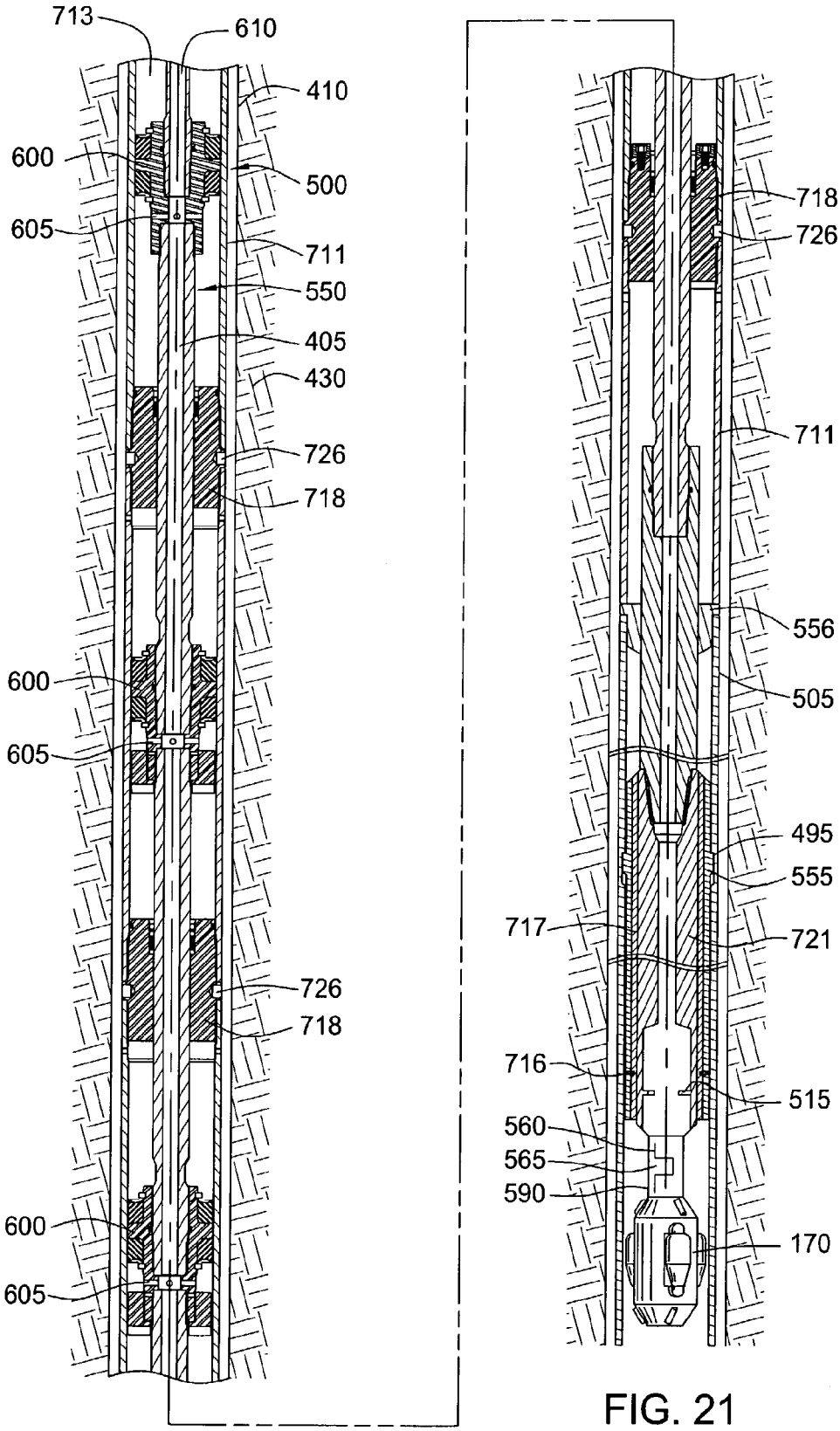
FIG. 21 is a cross-sectional view of an alternate embodiment of the expandable system of the present invention in the run-in configuration. The expandable system includes an expandable tubular and a setting tool releasably attached. An expander tool is connected to a lower end of the setting tool.
Figure 22:
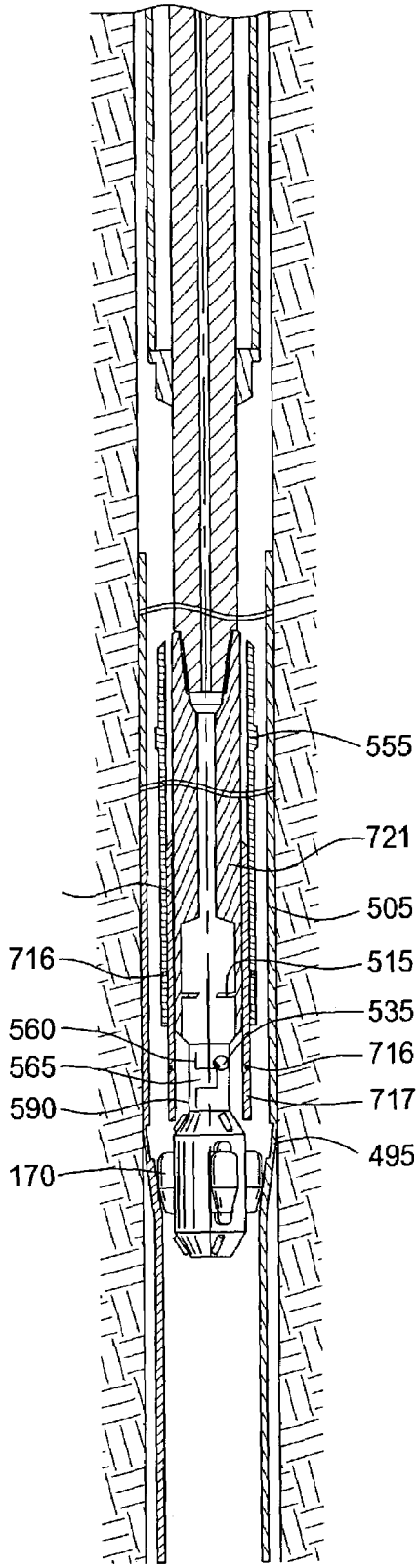
FIG. 22 is a cross-sectional view of the expandable system of FIG. 21 showing the remaining length of the expandable tubular expanded into contact with the wellbore.

In yet another embodiment depicted in FIGS. 21–22, the expandable system 500 may comprise the setting tool 550 and the expandable tubular 505 of FIGS. 17–20. Like parts in FIGS. 21–22 are labeled with like numbers to FIGS.

17–20. The above discussion of FIGS. 17–20 applies equally to the embodiment of FIGS. 21–22. In this embodiment, the expander tool 170 is connected, preferably threadedly connected, to a lower end of the same working string 405 as the setting tool 550.

Unlike the expandable system 500 of FIGS. 17–20, a circulating ball sub 590 is located below the ball retaining assembly 515 in the tubular body 721 in the embodiment of FIGS. 21–22. A sleeve 560 is disposed in the inner diameter of the circulating ball sub 590. The sleeve 560 has a fluid bypass 565 therearound which allows fluid flow therethrough. Below the circulating ball sub 590 is the expander tool 170, which is connected to the circulating ball sub 590. The sleeve 560 prevents the ball 535 (see FIG. 22) from entering the expander tool 170 and causing damage to the expander tool 170.

In operation, the expandable system 500, including the expandable tubular 505 and the setting tool 550 releasably connected by the collet fingers 555, is run into the wellbore 410 with the connected expander tool 170, as depicted in FIG. 21. The compressive force is exerted on the expandable tubular 505 by the setting tool 550 as described above in relation to FIGS. 17–20 (the ball 535 is dropped into the ball retaining assembly 515 and fluid pressure increased) so that the expandable tubular 505 is anchored within the wellbore 410. Then the collet fingers 555 are released by increased pressure within the working string 405 as described above in relation to FIGS. 17–20 so that the setting tool 550 and the attached expander tool 170 are moveable axially and rotationally relative to the expandable tubular 505 and the wellbore 410.

Next, fluid pressure is even further increased within the working string 405 so that the ball 535 is forced into the circulating ball sub 590 and caught by the sleeve 560 disposed therein, as shown in FIG. 22. Fluid flow around the sleeve 560 through the fluid bypass 565 actuates the hydraulically-powered expander tool 170. In this way, the expander tool 170, without removing the working string 405 from the wellbore 410, is subsequently used to expand the expandable tubular 505 along its length, as shown in FIG. 22. After expansion of the length of the expandable tubular 505 into the inner diameter of the wellbore 410, the expander tool 170, setting tool 550, and collet fingers 555 are removed from the wellbore 410 to the surface. This embodiment advantageously permits anchoring and expansion of the expandable tubular 505 in one run-in of the tubular string.

In the embodiments of FIGS. 17–22, the expandable tubular 505 may be heat treated so that the anchor portion is located at the lower portion of the expandable tubular 505. The expander tool 170 may then be used to expand the remaining portion of the expandable tubular 505 from the bottom up, rather than from the top down. Also in these embodiments, the setting tool 550 may be used to pull up on the expandable tubular 505 in relation to the collet fingers 555. In this alternate embodiment, the expandable tubular 505 is compressed between the groove 495 which has the collet fingers 555 therein and the connecting member 556, but the collet fingers 555 and the groove 495 in this variation are located above the tubular member 711. The upper end of the tubular member 711 rests against the connecting member, which in turn rests against the lower end of the expandable tubular 505.

In the embodiments discussed in FIGS. 17–22, the collet fingers 555 may be replaced by a shearable connection which is used to temporarily connect the expandable tubular 505 and the setting tool 550 until the anchor is set within the wellbore 410. Once the expandable tubular 505 is expanded into frictional contact with the wellbore 410 sufficient to anchor the expandable tubular 505 within the wellbore 410, the connection is sheared so that the setting tool 550 is moveable axially and rotationally within the wellbore 410. Alternatively, a threaded connection between the setting tool 550 and the expandable tubular 505 may be used as the releasable connection between the setting tool 550 and the expandable tubular 505, and the connection may be unthreaded when it is desired to release the setting tool 550 from the expandable tubular 505.

It will be apparent to those of skill in the art that the above described embodiments of the invention provide significant advantages over the expansion methods of the prior art, facilitate achievement of expansion ratios hitherto unavailable, and provide alternative configuration anchors and packers. Furthermore, in addition to the applications described above, the invention may be utilised to, for example, anchor piles in bores drilled in the sea bed, for use in securing offshore structures. The above embodiments also relate solely to applications in which tubing is plastically deformed; in alternative embodiments, the invention may be utilised to provide only elastic deformation, such that release of the deforming force allows the tubing to return to its original form.

The invention claimed is:

1. A method of expanding tubing downhole, the method comprising:
   - providing a section of expandable tubing of a first diameter; and
   - axially compressing at least a portion of the tubing to induce buckling at the portion, such that the buckled portion has a larger second diameter,
   - wherein the portion of tubing is predisposed to induce buckling at the portion by heat treatment.

2. A method of claim 1, wherein axially compressing the at least a portion of the tubing to induce buckling at the portion comprises axially compressing the tubing between a means for pulling the tubing axially and a releasable connection located between the means for pulling the tubing axially and the tubing.

3. Tubing running and expansion apparatus comprising:
   - a length of expandable tubing; and
   - a running tool for supporting the tubing on a running string and including means for compressing the tubing to induce buckling and expansion thereof, wherein a releasable connection supports the tubing on the running string.

4. The apparatus of claim 3, wherein the releasable connection is a collet.

5. The apparatus of claim 3, wherein the releasable connection is a shearable connection.

6. The apparatus of claim 3, wherein means for compressing the tubing comprises a piston movable within a cylinder to compress the tubing between the running string and the releasable connection.

7. The apparatus of claim 6, wherein at least a portion of the length of expandable tubing is heat treated to buckle at the portion.

8. An apparatus for anchoring an expandable tubular within a wellbore, comprising:
   - an expandable tubular having modified tensile strength along a portion of the expandable tubular; and
   - a tool for axially compressing the expandable tubular so that the expandable tubular deforms radially according to the tensile strength of the portion to anchor the expandable tubular within the wellbore.

9. The apparatus of claim 8, wherein the tensile strength is modified by heat treatment.

10. The apparatus of claim 8, wherein an outer diameter of the portion of the expandable tubular is altered to increase anchoring ability of the expandable tubular within the wellbore.

11. The apparatus of claim 8, wherein an outer diameter of the portion of the expandable tubular is knurled.

12. The apparatus of claim 8, wherein an outer diameter of the portion of the expandable tubular is rubber coated.

13. The apparatus of claim 8, wherein an outer diameter of the portion of the expandable tubular comprises spikes.

14. The apparatus of claim 8, further comprising an expander tool connected to the tool for axially compressing the expandable tubular.

15. The apparatus of claim 8, wherein the tool for axially compressing the expandable tubular comprises a setting tool for applying a load on the expandable tubular through a releasable connection between the expandable tubular and the setting tool.

16. The apparatus of claim 15, wherein the load is applied by at least one piston movable within at least one cylinder through fluid pressure.

17. The apparatus of claim 15, wherein the releasable connection comprises a collet.

18. The apparatus of claim 15, wherein the releasable connection comprises a shearable connection.

19. The apparatus of claim 15, wherein the releasable connection comprises a rotational connection.

20. The apparatus of claim 8, wherein the tool is attachable to the tubular and comprises a fixed location and a force applied to the tubular toward the fixed location.

21. A method for anchoring an expandable tubular in a wellbore, comprising:

modifying the tensile strength of a portion of the expandable tubular;

running the expandable tubular into the wellbore; and compressing the expandable tubular axially so that an outer diameter of the portion of the expandable tubular grippingly contacts an inner diameter of the wellbore.

22. The method of claim 21, further comprising altering the outer diameter of the portion of the expandable tubular to increase gripping contact of the expandable tubular in the wellbore prior to running the expandable tubular into the wellbore.

23. The method of claim 21, wherein modifying the tensile strength of the portion of the expandable tubular comprises heat treating the portion of the expandable tubular.

24. The method of claim 21, wherein the tensile strength is modified to progress along the length of the expandable tubular.

25. The method of claim 21, further comprising introducing an expander tool into the wellbore to expand the expandable tubular into gripping contact with the wellbore.

26. The method of claim 21, wherein the expandable tubular is run into the wellbore releasably connected to a setting tool for compressing the expandable tubular axially.

27. The method of claim 21, wherein compressing the expandable tubular axially comprises releasably connecting a setting tool to the expandable tubular and using the setting tool to apply a load to the expandable tubular which opposes the releasable connection.

28. The method of claim 27, wherein the load is applied by at least one piston movable within at least one cylinder through fluid pressure.

29. A downhole anchor, comprising:

a tubing section having a gripping portion for grippingly engaging a surrounding structure, wherein the gripping portion is adapted to buckle when an axially compressive force is applied thereto, wherein the gripping portion has a modified tensile strength.

30. The downhole anchor of claim 29, wherein the gripping portion is heat treated to facilitate the buckling.

* * * * *